US008723042B2

(12) United States Patent
Yang et al.

(10) Patent No.: US 8,723,042 B2
(45) Date of Patent: May 13, 2014

(54) FLEXIBLE FLAT CABLE AND MANUFACTURING METHOD THEREOF

(75) Inventors: Yong Suk Yang, Daejeon (KR); In-Kyu You, Daejeon (KR); Jae Bon Koo, Daejeon (KR); Su Jae Lee, Daejeon (KR); Taeyoub Kim, Seoul (KR); Soon-Won Jung, Daejeon (KR); Kang-Jun Baeg, Jeollanam-do (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 176 days.

(21) Appl. No.: 13/406,546

(22) Filed: Feb. 28, 2012

(65) Prior Publication Data

US 2012/0235961 A1 Sep. 20, 2012

(30) Foreign Application Priority Data

Mar. 17, 2011 (KR) ..... 10-2011-0023979
Jul. 14, 2011 (KR) ..... 10-2011-0069863

(51) Int. Cl.
*H01B 7/00* (2006.01)

(52) U.S. Cl.
USPC ..... 174/110 R; 174/117 R; 174/117 F; 174/117 FF

(58) Field of Classification Search
USPC ..... 174/110 R, 113 R, 115, 117 R, 117 F, 174/117 FF, 112
See application file for complete search history.

(56) References Cited

U.S. PATENT DOCUMENTS

| | | | | | |
|---|---|---|---|---|---|
| 4,644,092 | A * | 2/1987 | Gentry | 174/36 |
| 4,887,354 | A * | 12/1989 | Van Der Maaden | 29/868 |
| 5,110,998 | A * | 5/1992 | Muschiatti | 174/24 |
| 5,879,808 | A | 3/1999 | Wary et al. | |
| 7,399,929 | B2 * | 7/2008 | Ueno et al. | 174/117 FF |
| 2002/0182392 | A1 | 12/2002 | Welch et al. | |
| 2010/0044077 | A1 * | 2/2010 | Takamatsu et al. | 174/25 R |
| 2011/0232938 | A1 * | 9/2011 | Kodama et al. | 174/117 F |

FOREIGN PATENT DOCUMENTS

| | | | | |
|---|---|---|---|---|
| KR | 2007-0038025 | A | 4/2007 | |
| KR | 10-0721320 | B1 | 5/2007 | |
| KR | 2008-0008251 | A | 1/2008 | |
| KR | 2008-0010870 | A | 1/2008 | |
| KR | 10-0866497 | B1 | 11/2008 | |
| KR | 866497 | B1 * | 11/2008 | H01R 12/24 |
| KR | 10-0878993 | B1 | 1/2009 | |
| KR | 2010-0021913 | A | 2/2010 | |
| KR | 2010-0080137 | A | 7/2010 | |
| KR | 2010-0110008 | A | 10/2010 | |
| KR | 2010-0113939 | A | 10/2010 | |

* cited by examiner

*Primary Examiner* — William H Mayo, III
(74) *Attorney, Agent, or Firm* — Rabin & Berdo, P.C.

(57) ABSTRACT

A flexible flat cable which includes wire cores, insulation coating layers surrounding the wire cores, shield coating layers surrounding the insulation coating layers, an upper insulation plate layer formed on the shield coating layers, a lower insulation plate layer formed under the shield coating layers and opposite to the upper insulation plate layer, and a shield plate layer formed under the lower insulation plate layer.

9 Claims, 12 Drawing Sheets

FLEXIBLE FLAT CABLE AND MANUFACTURING METHOD THEREOF

CROSS-REFERENCE TO RELATED APPLICATIONS

This U.S. non-provisional patent application claims priority under 35 U.S.C. §119 to Korean Patent Application Nos. 10-2011-0023979 and 10-2011-0069863, filed on Mar. 17, 2011 and Jul. 14, 2011, the entirety of which is incorporated by reference herein.

BACKGROUND

The inventive concept relates to a cable and a manufacturing method thereof and, more particularly, to a flexible flat cable, capable of realizing high speed communication and a manufacturing method thereof.

The modern digital devices have been developed for satisfying various conditions such as approach of various techniques, fast information processing speed, and portability and accessibility for use at any time and any place according to demands of users. Thus, a signal transmission speed of a digital circuit have been based on a high speed technique for high speed information processing to be faster in several GHz band. A level of an applying voltage for driving various devices using a limited power source has been lowered. A digital clock signal with a lower voltage level and a shorter period may have a shorter rising/falling time. This means that a power spectrum of a digital signal is distributed throughout a broadband.

A high performance display such as a three-dimensional thin layer transistor-liquid crystal display TV (3D TFT-LCD TV) also requires a high speed series communication. Interface between modules of the high speed series communication takes a point-to-point connection that transmission chips are connected to reception chips in one-to-one correspondence, and a transmission channel is a cable.

Electromagnetic interference (EMI) may be generated in a signal transfer course on a general flexible flat cable (FFC). The EMI generates distortion and crosstalk of a signal and inter-symbol interference (ISI) problems in transmission of a mass data, thereby deteriorating a normal operation of the digital circuit.

SUMMARY

Embodiments of the inventive concept may provide a flexible flat cable capable of minimizing distortion and interference of a signal and a method of manufacturing the same.

Embodiments of the inventive concept may also provide a flexible flat cable capable of increasing or maximizing productivity and a method of manufacturing the same.

According to exemplary embodiments of the inventive concept, a flexible flat cable includes: wire cores; insulation coating layers surrounding the wire cores; shield coating layers surrounding the insulation coating layers; an upper insulation plate layer formed on the shield coating layers; a lower insulation plate layer formed under the shield coating layers and opposite to the upper insulation plate layer; and a shield plate layer formed under the lower insulation plate layer.

In some embodiments, the insulation coating layers may include parylene polymer.

In other embodiments, the parylene polymer may include at least one of parylene N, parylene C, and parylene D.

In still other embodiments, the parylene polymer may have a thickness having a range of about 10 μm to about 50 μm.

In yet other embodiments, the shield coating layers may be connected to each other between the upper insulation plate layer and the lower insulation plate layer.

In yet still other embodiments, the shield coating layers may include at least one of silver (Ag), copper (Cu), and aluminum (Al).

In further embodiments, the upper insulation plate layer and the lower insulation plate layer may include polyester.

In still further embodiments, the shield plate layer may include an aluminum foil.

In even further embodiments, the flexible flat cable may further include: ground terminals formed between the lower insulation plate layer and the shield plate layer corresponding to both side ends of the wire cores.

According to exemplary embodiments of the inventive concept, a method of manufacturing a flexible flat cable includes: forming insulation coating layers on wire cores; forming shield coating layers on the insulation coating layers; joining an lower insulation plate layer and a upper insulating plate layer under and on the shield coating layers, respectively, the shield coating layers connected to each other; and forming a shield plate layer under the lower insulation plate layer.

In some embodiments, forming the insulation coating layers may include forming the insulation coating layers by a high polymer vapor deposition method.

In other embodiments, forming the insulation coating layers by a high polymer vapor deposition method may include: evaporating parylene dimer; dividing the parylene dimer into parylene monomers; and depositing the parylene monomers on the wire cores.

In still other embodiments, the parylene monomers may be formed at a vacuum pressure equal to or greater than 50 mtorr.

In yet other embodiments, the method may further include: performing a cold trapping after depositing the parylene monomers.

According to exemplary embodiments of the inventive concept, a liquid crystal display device include: a liquid crystal panel; a source driver and a gat driver connected to an edge of the display panel; a timing controller outputting a data signal and a gate signal to the source driver and the gate driver; and a flexible flat cable connecting the timing controller to at least one of the source driver and the gate driver. Here, the flexible flat cable includes: wire cores; insulation coating layers surrounding the wire cores; shield coating layers surrounding the insulation coating layers; an upper insulation plate layer formed on the shield coating layers; a lower insulation plate layer formed under the shield coating layers and opposite to the upper insulation plate layer; and a shield plate layer formed under the lower insulation plate layer.

BRIEF DESCRIPTION OF THE DRAWINGS

The inventive concept will become more apparent in view of the attached drawings and accompanying detailed description.

DETAILED DESCRIPTION OF THE EMBODIMENTS

Figure 1:
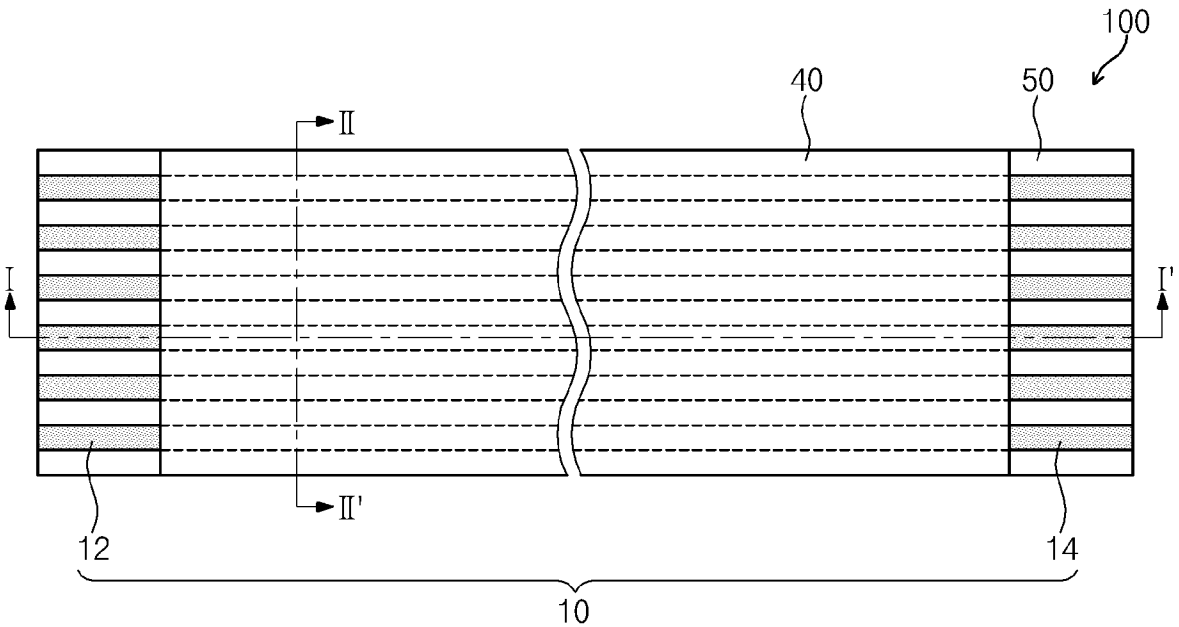
FIG. 1 is a plan view illustrating a flexible flat cable according to exemplary embodiments of the inventive concept.

The inventive concept will now be described more fully hereinafter with reference to the accompanying drawings, in which exemplary embodiments of the inventive concept are shown. The advantages and features of the inventive concept and methods of achieving them will be apparent from the following exemplary embodiments that will be described in more detail with reference to the accompanying drawings. It should be noted, however, that the inventive concept is not limited to the following exemplary embodiments, and may be implemented in various forms. Accordingly, the exemplary embodiments are provided only to disclose the inventive concept and let those skilled in the art know the category of the inventive concept. In the drawings, embodiments of the inventive concept are not limited to the specific examples provided herein and are exaggerated for clarity.

The terminology used herein is for the purpose of describing particular embodiments only and is not intended to limit the invention. As used herein, the singular terms "a," "an" and "the" are intended to include the plural forms as well, unless the context clearly indicates otherwise. As used herein, the term "and/or" includes any and all combinations of one or more of the associated listed items. It will be understood that when an element is referred to as being "connected" or "coupled" to another element, it may be directly connected or coupled to the other element or intervening elements may be present.

Similarly, it will be understood that when an element such as a layer, region or substrate is referred to as being "on" another element, it can be directly on the other element or intervening elements may be present. In contrast, the term "directly" means that there are no intervening elements. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Additionally, the embodiment in the detailed description will, be described with sectional views as ideal exemplary views of the inventive concept. Accordingly, shapes of the exemplary views may be modified according to manufacturing techniques and/or allowable errors. Therefore, the embodiments of the inventive concept are not limited to the specific shape illustrated in the exemplary views, but may include other shapes that may be created according to manufacturing processes. Areas exemplified in the drawings have general properties, and are used to illustrate specific shapes of elements. Thus, this should not be construed as limited to the scope of the inventive concept.

It will be also understood that although the terms first, second, third etc. may be used herein to describe various elements, these elements should not be limited by these terms. These terms are only used to distinguish one element from another element. Thus, a first element in some embodiments could be termed a second element in other embodiments without departing from the teachings of the present invention. Exemplary embodiments of aspects of the present inventive concept explained and illustrated herein include their complementary counterparts. The same reference numerals or the same reference designators denote the same elements throughout the specification.

Moreover, exemplary embodiments are described herein with reference to cross-sectional illustrations and/or plane illustrations that are idealized exemplary illustrations. Accordingly, variations from the shapes of the illustrations as a result, for example, of manufacturing techniques and/or tolerances, are to be expected. Thus, exemplary embodiments should not be construed as limited to the shapes of regions illustrated herein but are to include deviations in shapes that result, for example, from manufacturing. For example, an etching region illustrated as a rectangle will, typically, have rounded or curved features. Thus, the regions illustrated in the figures are schematic in nature and their shapes are not intended to illustrate the actual shape of a region of a device and are not intended to limit the scope of example embodiments.

Figure 2:
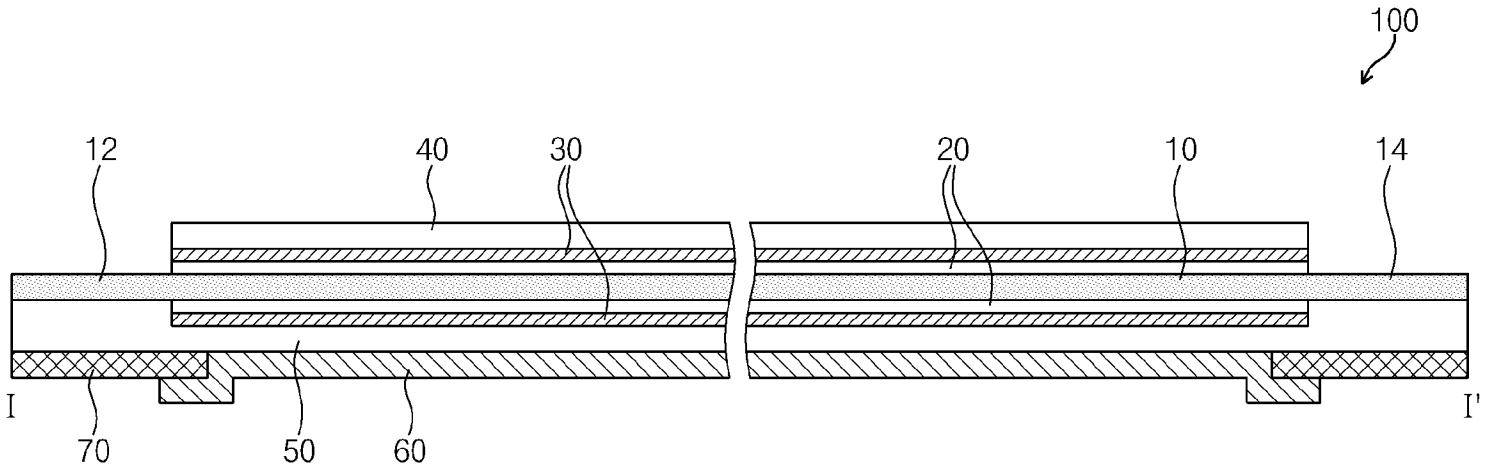
FIGS. 2 and 3 are cross-sectional views taken along lines I-I' and II-II' of FIG. 1, respectively.
Figure 3:
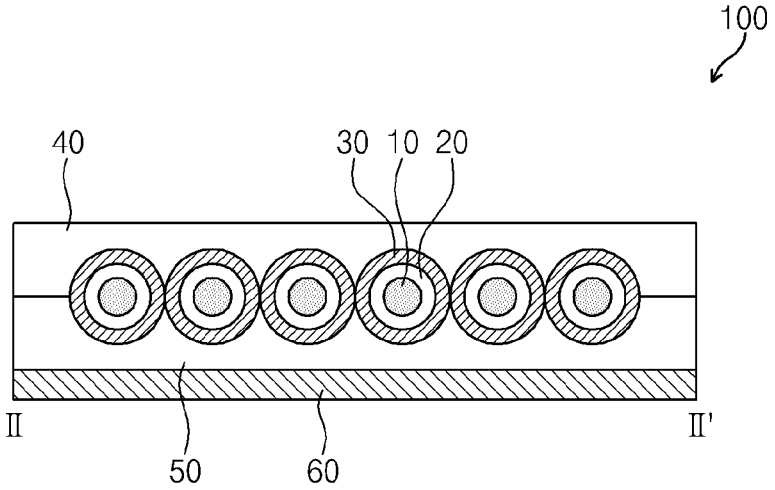

FIG. 1 is a plan view illustrating a flexible flat cable according to exemplary embodiments of the inventive concept. FIGS. 2 and 3 are cross-sectional views taken along lines I-I' and II-II' of FIG. 1, respectively.

Referring to FIGS. 1 through 3, a flexible flat cable 100 according to exemplary embodiments of the inventive concept may include insulation coating layers 20 of a parylene polymer surrounding wire cores 10, and shield coating layers 30 of metal components. The parylene polymer may have a high resistivity of about $10^{16}$ Ω·cm or more, and a low dielectric constant of about 2.95 or less. The insulation coating layers 20 of the parylene polymer may increase an electric insulation between the wire cores 10 and decrease a RC delay of a signal. The shield coating layers 30 may shield an electromagnetic wave between the wire cores 10.

Accordingly, the flexible flat cable 100 according to exemplary embodiments of the inventive concept may increase or maximize a transmission efficiency of the wire cores 10 and minimize distortion or interference of a signal.

The insulation coating layer 20 may include the parylene polymer having a thickness within a range of about 10 μm to about 50 μm. For example, the parylene polymer may include parylene N, parylene C, and/or parylene D. One aromatic hydrogen atom from the same monomer as the parylene N is substituted with one chlorine atom to form the parylene C. Two aromatic hydrogen atoms from the same monomer as the parylene N are substituted with two chlorine atoms to form the parylene D. The parylene N may be represented as the following chemical formula 1, the parylene C may be represented as the following chemical formula 2, and the parylene D may be represented as the following chemical formula 3.

[Chemical formula 1]

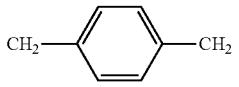

The parylene N may have a structure of a benzene ring combined with two methyl groups.

[Chemical formula 2]

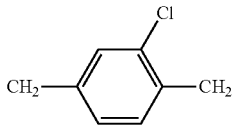

The parylene C may have a structure of a benzene ring combined with two methyl groups and the one chlorine atom.

[Chemical formula 3]

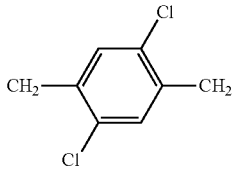

The parylene D may have a structure of a benzene ring combined with two methyl groups and the two chlorine atoms.

The wire cores 10 may include a conductive metal such as aluminum, gold, and/or silver. First and second terminals 12 and 14 disposed at both sides of the wire cores 10 may be exposed from the insulation coating layers 20, a shield coating layers 30, and an upper insulation plate layer 40. The wire cores 10 may be fixed side by side by a lower insulation plate layer 50 and the upper insulation plate layer 40. The shield coating layers 30 may be electrically connected to each other between the lower insulation plate layer 50 and the upper insulation plate layer 40.

The lower insulation plate layer 50 and the upper insulation plate layer 40 may protect the wire cores 10. The lower insulation plate layer 50 and the upper insulation plate layer 40 may include a high polymer such as polyester. A shield plate layer 60 may reduce electromagnetic interference (EMI) caused from the wire cores 10 and the outside. The shield plate layer 60 may include an aluminum foil. Ground terminals 70 may be disposed between the shield plate layer 60 and the lower insulation plate layer 50 corresponding to both side ends of the wire cores 10. The ground terminal 70 may include a conductive paste or a conductive metal thin layer.

Figure 4:
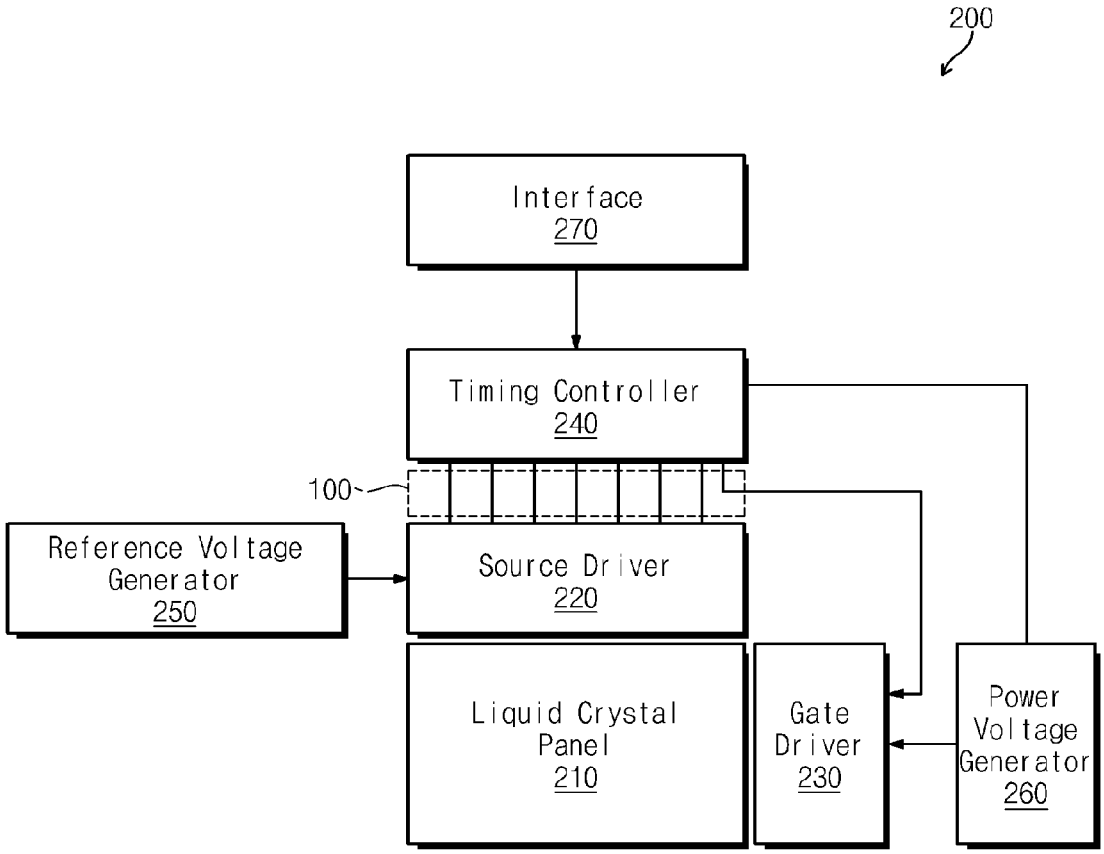
FIG. 4 is a block diagram illustrating a liquid crystal display device applied with the flexible flat cable of FIG. 1.

FIG. 4 is a block diagram illustrating a liquid crystal display device applied with the flexible flat cable of FIG. 1.

Referring to FIGS. 1 through 4, the flexible flat cable 100 may be connected between a timing controller 240 and a source driver 220 of a liquid crystal display device 200. The timing controller 240 may receive an image signal from an interface 270. Additionally, the flexible flat cable 100 may be connected between the timing controller 240 and a gate driver 230. The flexible flat cable 100 may transfer a data signal and a gate signal of about 1.5 Gbps or more. The source driver 220 may receive the data signal and a reference voltage from the timing controller 240 and a reference voltage generator 250 to provide a color signal synchronized with the gate signal to a data line of a liquid crystal panel 210. The gate driver 230 may receive the gate signal and a power voltage from the timing controller 240 and a power voltage generator 260 to provide a turn-on signal to a gate line of the liquid crystal panel 210. The liquid crystal panel 210 may realize a frame of about 120 Hz to about 240 Hz. For example, the flexible flat cable 100 may have an impedance within a range of about 90Ω to about 110Ω.

Thus, the flexible flat cable 100 according to exemplary embodiments of the inventive concept may transfer signals at high speed in the liquid crystal display device 200.

A method of manufacturing the flexible flat cable according to exemplary embodiments of the inventive concept will be described below.

Figure 5:
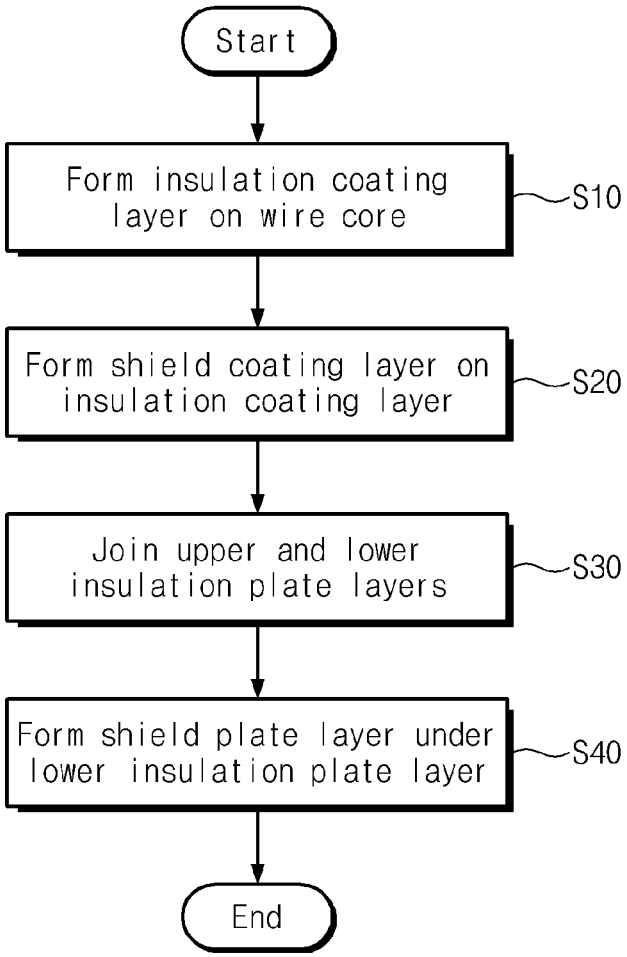
FIG. 5 is a flow chart illustrating a method of a flexible flat cable according to exemplary embodiments of the inventive concept.
Figure 6:
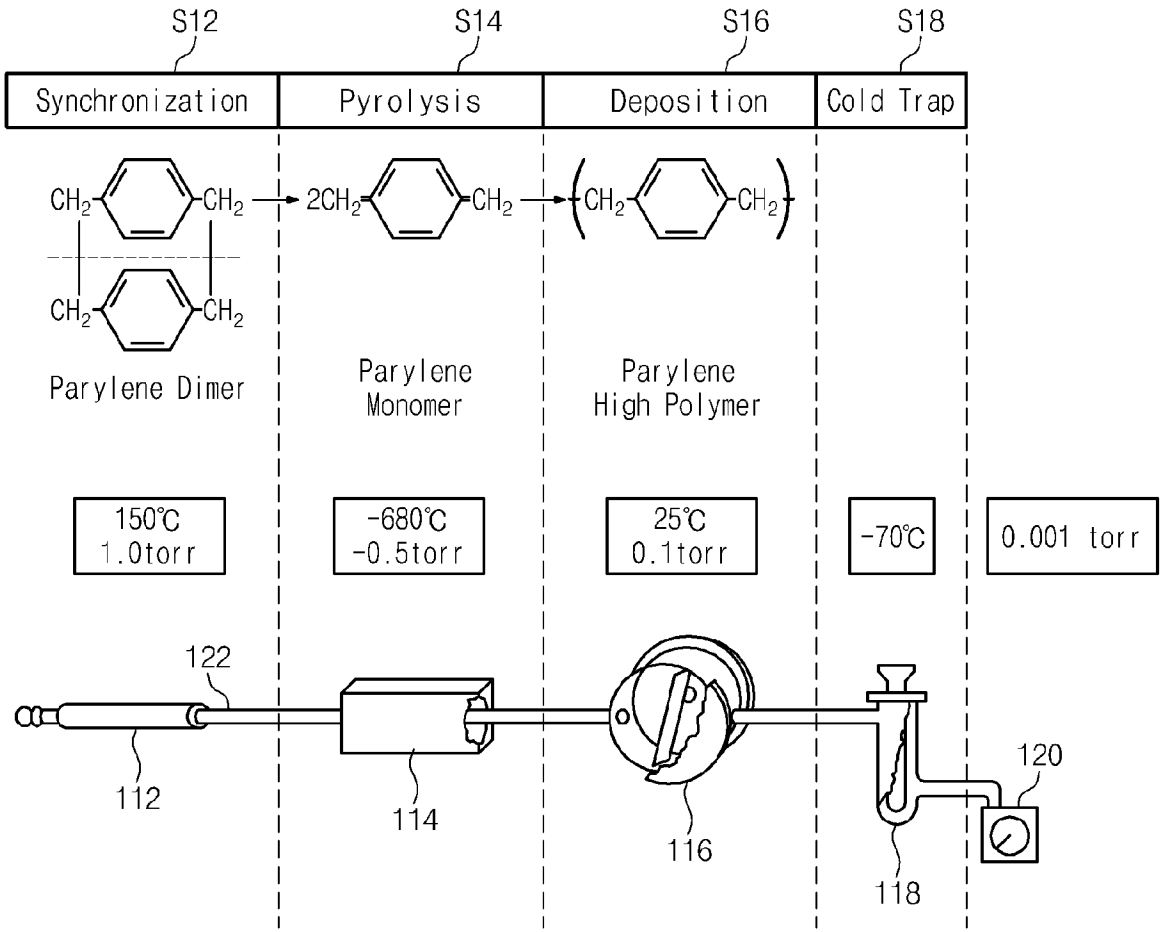
FIG. 6 schematically illustrates a method of forming a parylene polymer and an apparatus.
Figure 7A:
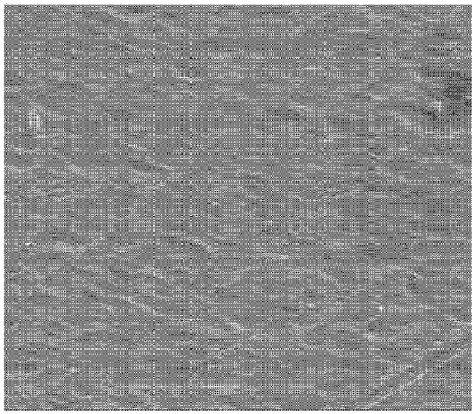
FIGS. 7A through 7F and 8A through 8F are photographs of a scanning electron microscope illustrating a variation of a thickness and surface roughness obtained by changing the amount of parylene C dimer.
Figure 7B:
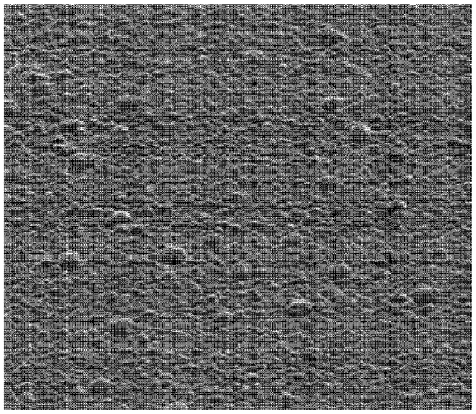
Figure 7C:
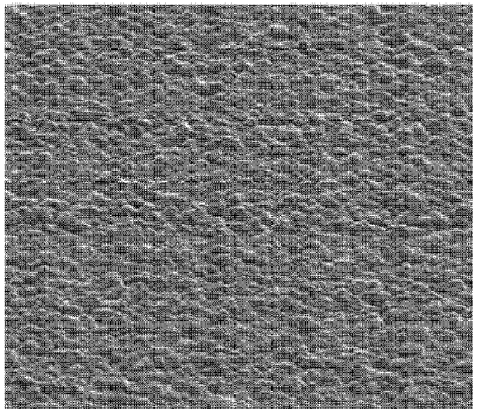
Figure 7D:
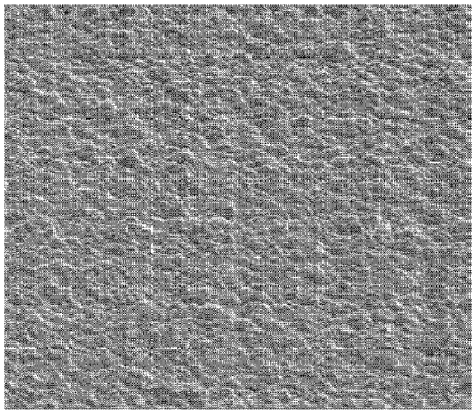
Figure 7E:
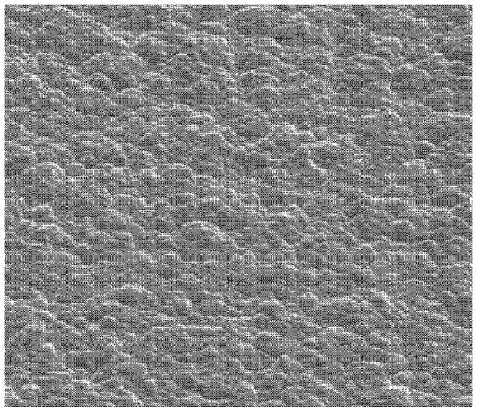
Figure 7F:
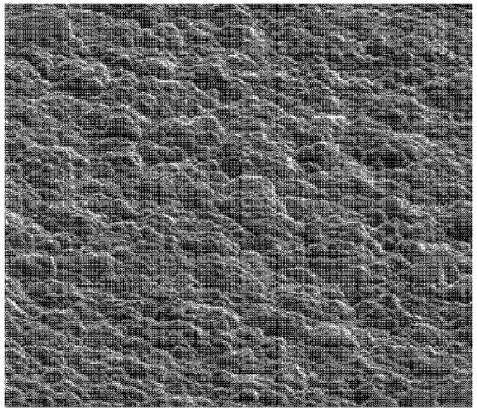
Figure 8A:
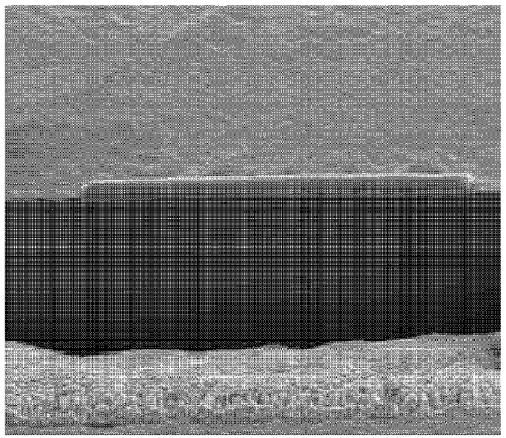
Figure 8B:
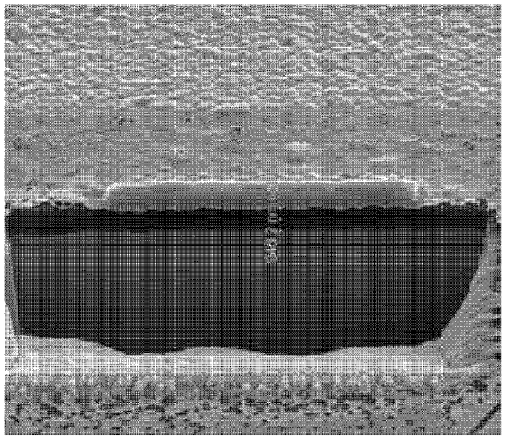
Figure 8C:
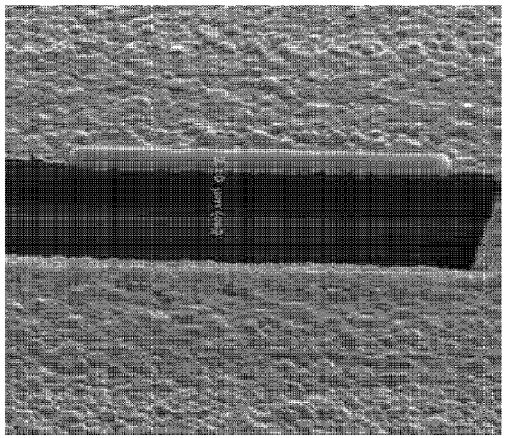
Figure 8D:
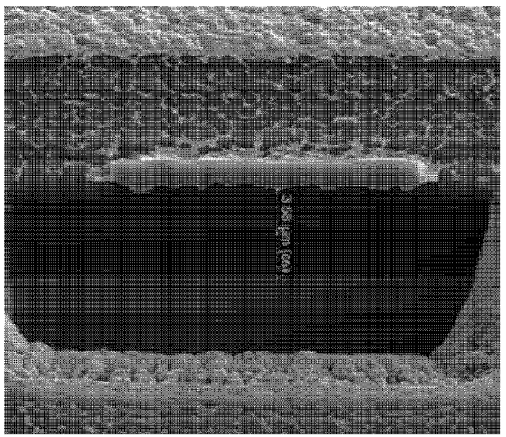
Figure 8E:
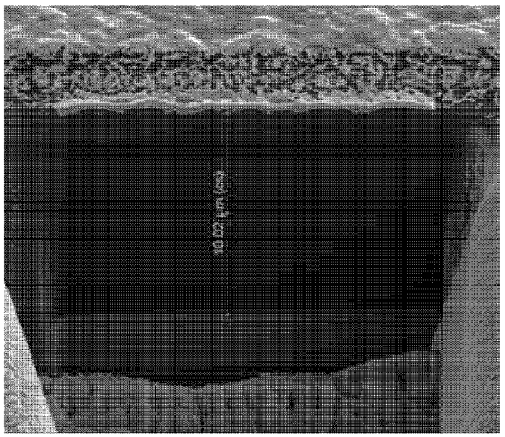
Figure 8F:
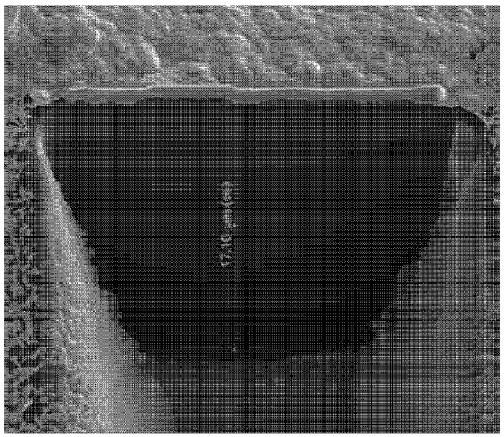
Figure 9A:
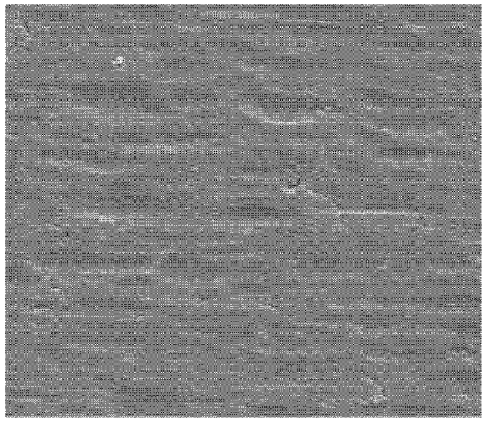
FIGS. 9A through 9F and 10A through 10E are photographs of a scanning electron microscope illustrating a variation of a thickness and surface roughness obtained by changing the amount of parylene C dimer.
Figure 9B:
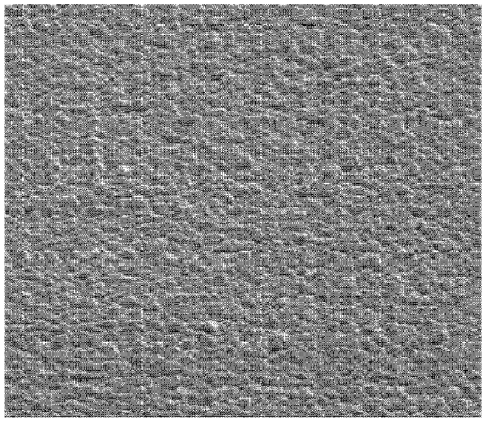
Figure 9C:
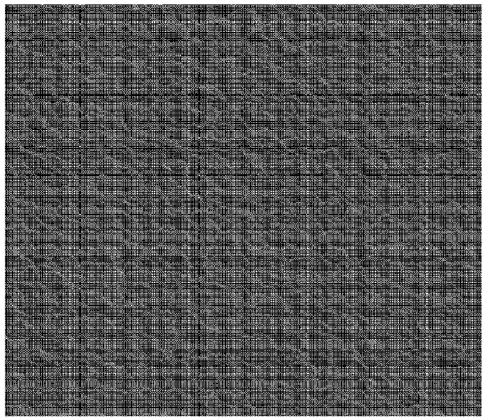
Figure 9D:
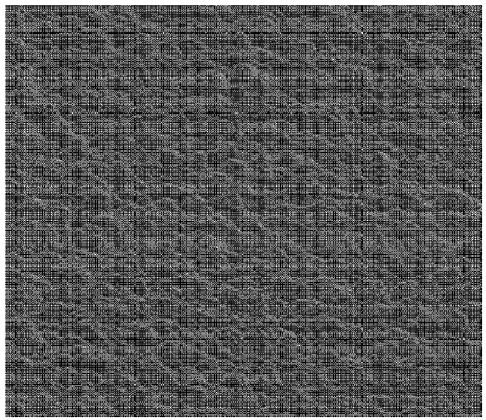
Figure 9E:
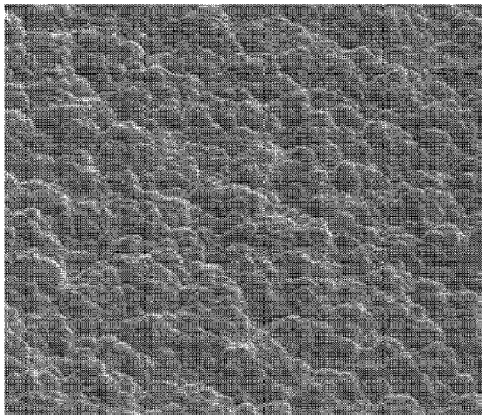
Figure 9F:
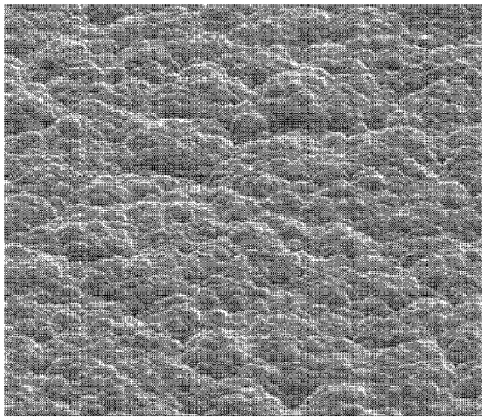
Figure 10A:
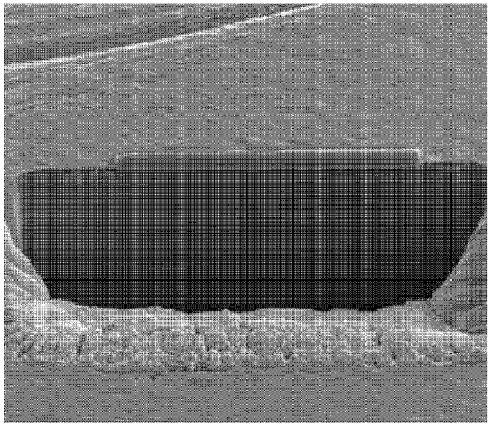
Figure 10B:
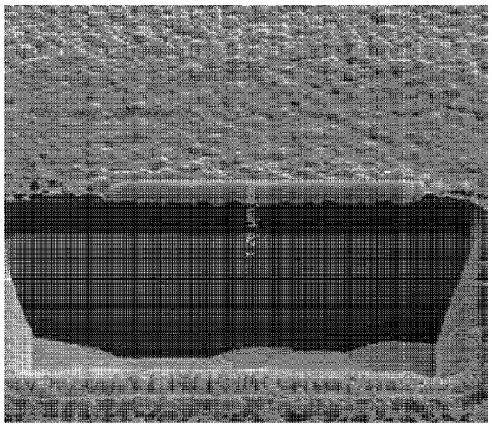
Figure 10C:
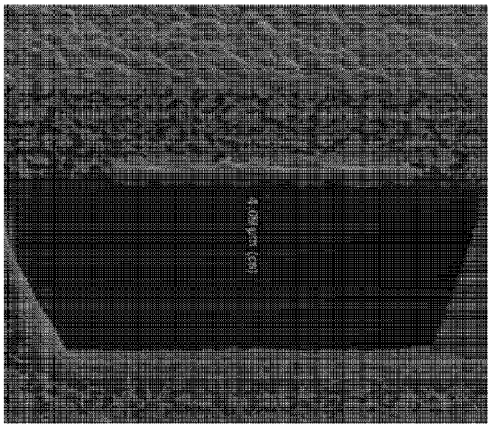
Figure 10D:
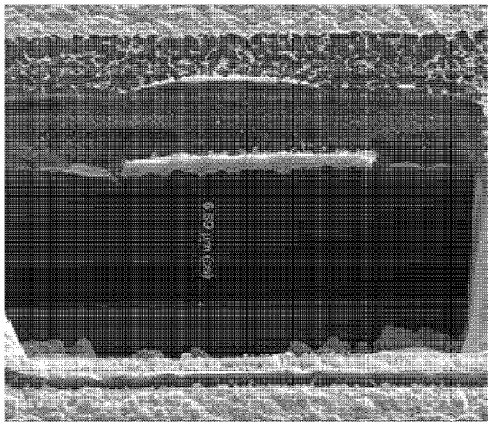
Figure 10E:
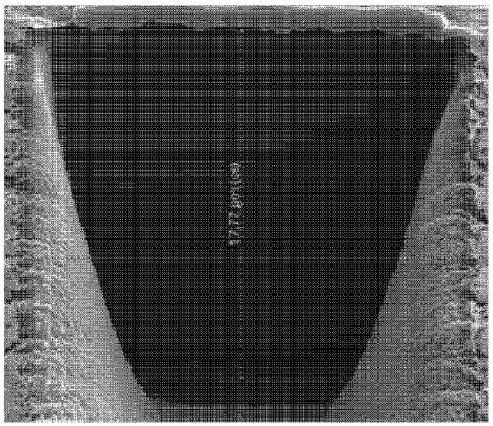

FIG. 5 is a flow chart illustrating a method of a flexible flat cable according to exemplary embodiments of the inventive concept. FIG. 6 schematically illustrates a method of forming a parylene polymer and an apparatus.

Referring to FIGS. 1 through 6, insulation coating layers 20 are formed on wire cores 20 (S10). The insulation coating layers 20 includes the parylene polymer. After parylene monomers are decomposed from a parylene dimer, the parylene monomers may be deposited on the wire cores 10 in high polymer, thereby forming the parylene polymer. In more detail, an initial material of the parylene dimer may exist in powder shape. First, a vaporizer 112 may heat the parylene dimer powder at a temperature of about 105° C. or more (e.g. about 150° C.) under a vacuum of about 10 mtorr to about 100 mtorr, thereby sublimating the parylene dimer in gas state, not melting (S12). A pyrolysis 114 may pyrolyze the parylene dimer into parylene monomers maintaining the powder shape (S14). If the parylene dimer being not completely pyrolyzed clings to a surface of the insulation coating layer 20, various characteristics including an optical characteristic of a coated parylene polymer may be deteriorated. Thus, it is very important to completely pyrolyze the parylene dimer into the parylene monomers.

A deposition chamber 116 is generally called a vacuum chamber. The pyrolyzed parylene monomers may be provided into the deposition chamber 116 to form the insulation coating layer 20 of the parylene polymer on the surface of the wire cores 10 (S16). The deposition mechanism for the parylene high polymer coating may be different from a conventional thin layer deposition method such as a physical vapor deposition (PVD) method or a chemical vapor deposition (CVD) method. For example, in the PVD method of metal, after evaporated metal atoms are moved by a surface diffusion, the evaporated metal atoms are combined with other surface atoms. In the CVD method, after a precursor is absorbed, the absorbed precursor reacts with the surface. In other words, in conventional deposition method, one of reaction products is a thin layer material for deposition, and others of the reaction products are gaseous materials separated from the thin layer material.

On the contrary, in a high polymer vapor deposition method according to exemplary embodiments of the inventive concept, the parylene monomers may have a condensation reaction on the surface of the wire cores 10 or the parylene monomers may clings to ends of free radicals of the parylene high polymer, thereby forming the insulation coating layer 20. Thus, a growth of a high polymer film is dependent on the condensation of monomers on a film surface, diffusion of monomers in a film, and reaction between ends of free radicals and monomers. A high polymer process includes an initiation reaction. In the initiation reaction, monomer molecules react with each other to form a diradical being initial high polymer chains. The chains grow through a propagation step. In the propagation step, the monomer molecules react with an end of the chain to form a chain having a length of one repeating unit. All two reactions described above are a function of monomer concentration in the film, and a deposition rate increases in proportion to the monomer concentration. A diffusion speed of the monomers in vapor is faster than a diffusion speed of the monomers in the film by several orders or more.

A dynamic absorption-desorption process may be performed by equilibrium between a gas state and a concentration in a surface. A growth interface is in equilibrium state. A surface concentration (Mfi) of the monomers at the film may be represented from Flory law by gaseous monomers in equilibrium and a chemical potential at the film surface. If gaseous parylene monomers are in molecule state and the parylene monomers in the insulation coating layer 20 have a very low concentration, the deposition rate ($C^F_{M,s}$) of the parylene is represented as the following mathematical formula 1.

$$\left(C^F_{M,s} = \frac{\rho_f}{K_H}\frac{P}{P_{sat}}\right) \quad \text{[Mathematical formula 1]}$$

Where the $\rho_f$ is a density of a polymer film (1.11 g/cm$^3$), the $K_H$ is a dimensionless constant having a value of about 4.6, the P is a partial pressure of the parylene monomers, and the $P_{sat}$ is a vapor pressure of a pure parylene monomers at a temperature of the insulation coating layer 20. In the mathematical formula 1, the $K_H$ is unrelated to the concentration of the parylene monomers and is hardly dependent on a temperature. As an evaporation temperature of the insulation coating layer 20 is reduced, the Psat is rapidly reduced and the concentration of the parylene monomers in the insulation coating layer 20 and at the surface thereof increases. The increased concentration of the parylene monomers of the insulation coating layer 20 causes a faster reaction at the film. As a result, a fast deposition speed is realized.

A cold trap part 118 may cool the parylene monomer gas from the deposition chamber 116 at a temperature with a range of about −70° C. to −100° C. to perform cold trapping (S18). A mechanical vacuum pump 120 may provide a pressure flowing the parylene monomers gas from the vaporizer 112 to the deposition chamber 116. The mechanical vacuum pump 120 may include a rotary pump or a dry pump pumping out air of the inside of the deposition chamber 116 in low vacuum. A connection pipe 122 may be connected from the vaporizer 112 to the mechanical vacuum pump 120, and be provided with a valve (not shown) controlling a fluid therein.

Accordingly, because the method of manufacturing the flexible flat cable 100 according to exemplary embodiments of the inventive concept forms the insulation coating layer 20 with excellent electric insulation characteristic in the deposition chamber 116 of low vacuum, productivity may be increased or maximized.

FIGS. 7A through 7F and 8A through 8F are photographs of a scanning electron microscope illustrating a variation of a thickness and surface roughness obtained by changing the amount of parylene C dimer at a vacuum pressure less than 50 mtorr.

Referring to FIGS. 6 through 8F, when a reference source amount of the parylene C dimer is defined as "A" and the source amount of the parylene C dimer is sequentially increased by 0.2 A, 2 A, 4 A, 6 A, 10 A, and 20 A, the surface roughness of the parylene polymer thin layer may increase and the thickness of the parylene polymer thin layer may also increase. The deposition chamber 116 may have a low pressure less than 50 mtorr.

FIGS. 9A through 9F and 10A through 10E are photographs of a scanning electron microscope illustrating a variation of a thickness and surface roughness obtained by changing the amount of parylene C dimer at a vacuum pressure equal to or greater than 50 mtorr. Here, FIGS. 9A through 10E show parylene polymer thin layers deposited at a pressure of the deposition chamber 116 greater than the pressure of the deposition chamber 116 in which the parylene polymer thin layers of FIGS. 7A through 8F are formed.

Referring to FIGS. 6 through 10E, when the reference source amount of the parylene C dimer is defined as "A" and the source amount of the parylene C dimer is sequentially increased by 0.2 A, 2 A, 4 A, 6 A, 10 A, and 20 A, the surface roughness and the thickness of the parylene polymer thin layer may increase. The deposition chamber 116 may have a high pressure equal to or greater than 50 mtorr. FIG. 10F corresponding to FIG. 9F is omitted. The insulation coating layer 20 including the parylene polymer thin layer may have a thickness in proportion to a pressure. This will be described with reference to FIG. 12 in more detail later.

Figure 11:
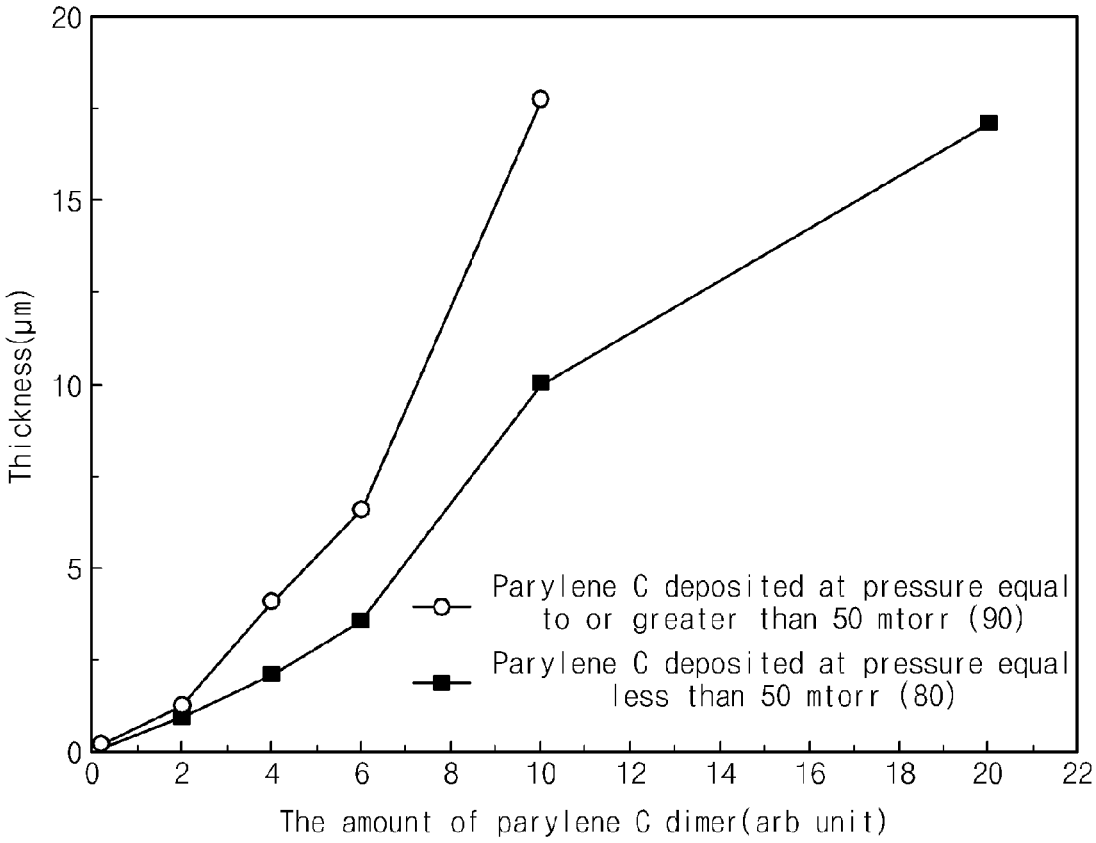
FIG. 11 is a thickness graph of parylene C thin layers formed by changing the amount of the parylene C dimer of FIGS. 7*a* through 7F, 8A through 8F, 9A through 9F, and 10A through 10E.

FIG. 11 is a thickness graph of parylene C thin layers formed by changing the amount of the parylene C dimer of FIGS. 7*a* through 7F, 8A through 8F, 9A through 9F, and 10A through 10E.

Referring to FIG. 11, a thickness gradient of the parylene C thin layer deposited at a pressure equal to or greater than 50 mtorr may be greater than a thickness gradient of the parylene C thin layer deposited at a pressure less than 50 mtorr. For example, the parylene C thin layer (80) deposited at the pressure less than 50 mtorr may have the thickness gradient of about 1 as the amount of the dimer increases. The parylene C thin layer (90) deposited at the pressure equal to or greater than 50 mtorr may have the thickness gradient of about 2 as the amount of the dimer increases. Accordingly, the parylene polymer may have the thickness linearly increasing in proportion to each of the amount of the dimer and the pressure of the deposition chamber 116.

Figure 12:
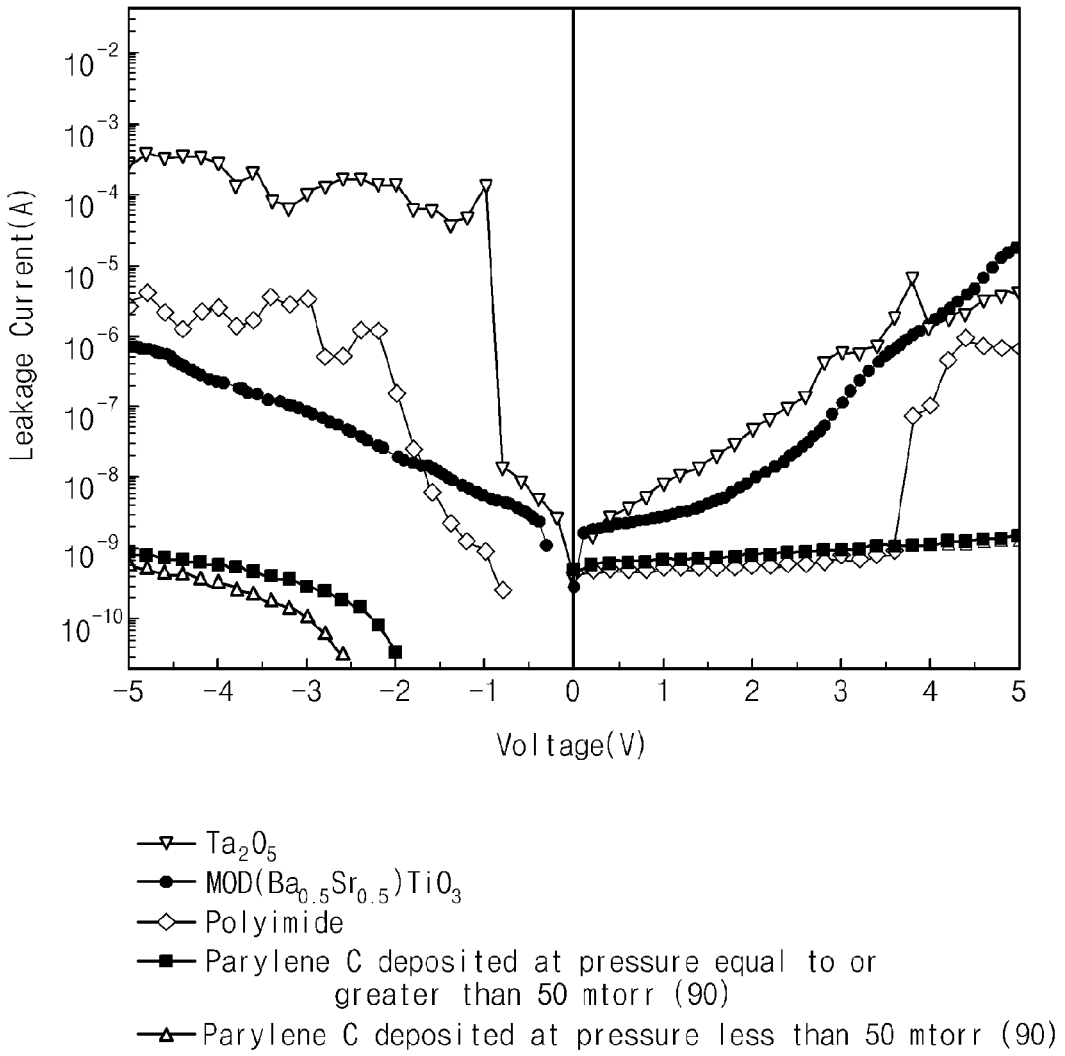
FIG. 12 is a graph illustrating electrical characteristics of parylene C thin layers.

FIG. 12 is a graph illustrating electrical characteristics of parylene C thin layers.

Referring to FIG. 12, the parylene C thin layers 80 and 90 may have a leakage current less than that of each of a tantalum oxide ($Ta_2O_5$), a barium-strontium-titanium oxide ($(Ba_{0.5}Sr_{0.5})TiO_3$), and a polyimide layer at a bias voltage between −5V and +5V. Here, the parylene C thin layers 80 and 90, the metal oxide layers, and the polyimide layer may have thicknesses similar to each other. The parylene C thin layers 80 and 90 may have electric insulation characteristic greater than those of the metal oxide layers and the polyimide layer. The parylene C thin layers 80 and 90 may have substantially the same leakage current in a bias voltage range of 0V to 5V. On the contrary, the parylene C thin layers 80 and 90 may have leakage currents different from each other in a bias voltage range of −2V to −5V. The parylene C thin layer 80 deposited at the pressure less than 50 mtorr may have a leakage current higher than that of the parylene thin layer 90 deposited at the pressure equal to or greater than 50 mtorr. The parylene C thin layers 80 and 90 may have the resistivity of about $10^{16}$ Ωcm. The parylene C thin layers 80 and 90 may have the thickness within a range of about 10 μm to about 50 μm.

Accordingly, the method of manufacturing the flexible flat cable according to exemplary embodiments of the inventive concept may form the insulation coating layer 20 of the parylene polymer on the wire cores 10 by the high polymer vapor deposition method.

Again referring to FIGS. 1 through 6, the shield coating layer 30 is formed on the insulation coating layer 20 (S20). The shield coating layer 30 may include a conductive paste or a conductive thin layer. The conductive paste may include silver (Ag). The conductive thin layer may include at least one of copper (Cu), silver (Ag), and aluminum (Al) formed by a physical vapor deposition method or a chemical vapor deposition method.

Subsequently, the upper and lower insulation plate layers 40 and 50 are joined (S30). The upper and lower insulation plate layers 40 and 50 may include a polyester film. A plurality of the shield coating layers 30 may be electrically connected to each other in the upper and lower insulation plate layers 40 and 50.

Finally, the ground terminal 70 and the shield plate layer 60 are formed under the lower insulation plate layer 50 (S40). The ground terminal 70 may include a conductive paste or a conductive metal thin layer. The conductive metal thin layer may be patterned by a photolithography process. The shield plate layer 60 may include an aluminum foil.

As described above, according to exemplary embodiments of the inventive concept, since the wire cores are surrounded by the insulation coating layers of the parylene polymer and the shield coating layers of metal components, it is possible to reduce or prevent distortion and interference of the signal. The parylene polymer may be deposited in the deposition chamber having a low vacuum of about 50 mtorr or more. Thus, the method of manufacturing the flexible flat cable according to exemplary embodiments of the inventive concept may increase or maximize productivity.

While the inventive concept has been described with reference to example embodiments, it will be apparent to those skilled in the art that various changes and modifications may be made without departing from the spirit and scope of the inventive concept. Therefore, it should be understood that the above embodiments are not limiting, but illustrative. Thus, the scope of the inventive concept is to be determined by the broadest permissible interpretation of the following claims and their equivalents, and shall not be restricted or limited by the foregoing description.

What is claimed is:

1. A flexible flat cable comprising:

wire cores;

insulation coating layers surrounding the wire cores;

shield coating layers surrounding the insulation coating layers;

an upper insulation plate layer formed on the shield coating layers;

a lower insulation plate layer formed under the shield coating layers and opposite to the upper insulation plate layer; and a shield plate layer formed under the lower insulation plate layer.

2. The flexible flat cable of claim 1, wherein the insulation coating layers include parylene polymer.

3. The flexible flat cable of claim 2, wherein the parylene polymer includes at least one of parylene N, parylene C, and parylene D.

4. The flexible flat cable of claim 2, wherein the parylene polymer has a thickness having a range of about 10 μm to about 50 μm.

5. The flexible flat cable of claim 1, wherein the shield coating layers are connected to each other between the upper insulation plate layer and the lower insulation plate layer.

6. The flexible flat cable of claim 1, wherein the shield coating layers include at least one of silver (Ag), copper (Cu), and aluminum (Al).

7. The flexible flat cable of claim 1, wherein the upper insulation plate layer and the lower insulation plate layer include polyester.

8. The flexible flat cable of claim 7, wherein the shield plate layer includes an aluminum foil.

9. The flexible flat cable of claim 1, further comprising;

ground terminals formed between the lower insulation plate layer and the shield plate layer corresponding to both side ends of the wire cores.

* * * * *